United States Patent [19]

Caille

[11] 4,233,799

[45] Nov. 18, 1980

[54] DISTRIBUTING MACHINE FOR PLACING STORED OBJECTS ON GRILL STANDS

[75] Inventor: Gilles Caille, Paris, France

[73] Assignee: Societe Anonyme Expandet, Paris, France

[21] Appl. No.: 34,280

[22] Filed: Apr. 27, 1979

[30] Foreign Application Priority Data

May 29, 1978 [FR] France ..... 78 15886

[51] Int. Cl.[3] ..... B65B 5/10

[52] U.S. Cl. ..... 53/154; 53/240; 53/246; 53/253

[58] Field of Search ..... 53/154, 240, 246, 247, 53/250, 253

[56] References Cited

U.S. PATENT DOCUMENTS

| | | | |
|---|---|---|---|
| 2,942,392 | 6/1960 | McCain et al. | 53/246 |
| 3,064,406 | 11/1962 | Kennedy | 53/240 |
| 3,080,033 | 3/1963 | Scott et al. | 53/246 |
| 3,411,266 | 11/1968 | Dix | 53/246 |
| 3,456,424 | 7/1969 | Thurston | 53/240 X |

*Primary Examiner*—John Sipos

*Attorney, Agent, or Firm*—Fisher, Christen & Sabol

[57] ABSTRACT

A machine for placing stored objects on grill stand is disclosed which has a plate carrying the grills to be filled and which successively moves them under a plurality of distributing stations. The distributing stations are continuously fed pins from bulk pin bins, and have pin transfer carriages to transfer pins between the distributing stations and grills. Individual push rod sets cooperate with the transfer carriages to make the pins go from the transfer carriages into the grills. Suitable mechanisms control the longitudinal and crosswise movement of the transfer carriages above the grills so that at each loading station, a row of the grill is filled, preferably in two passes, the pins of the row being distributed successively in alternating pockets.

5 Claims, 13 Drawing Figures

FIG.12
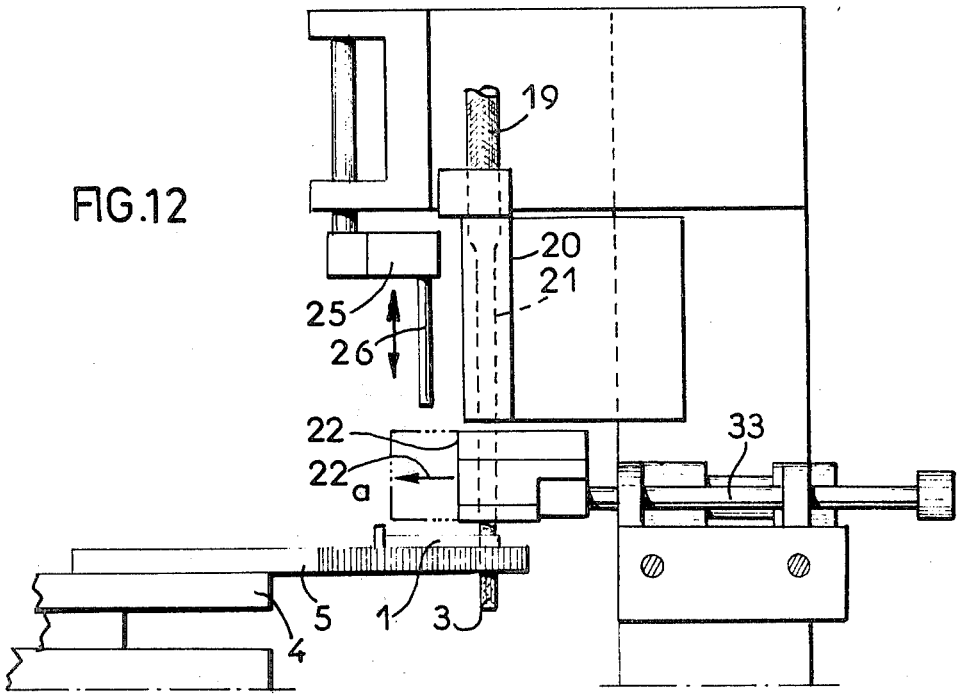
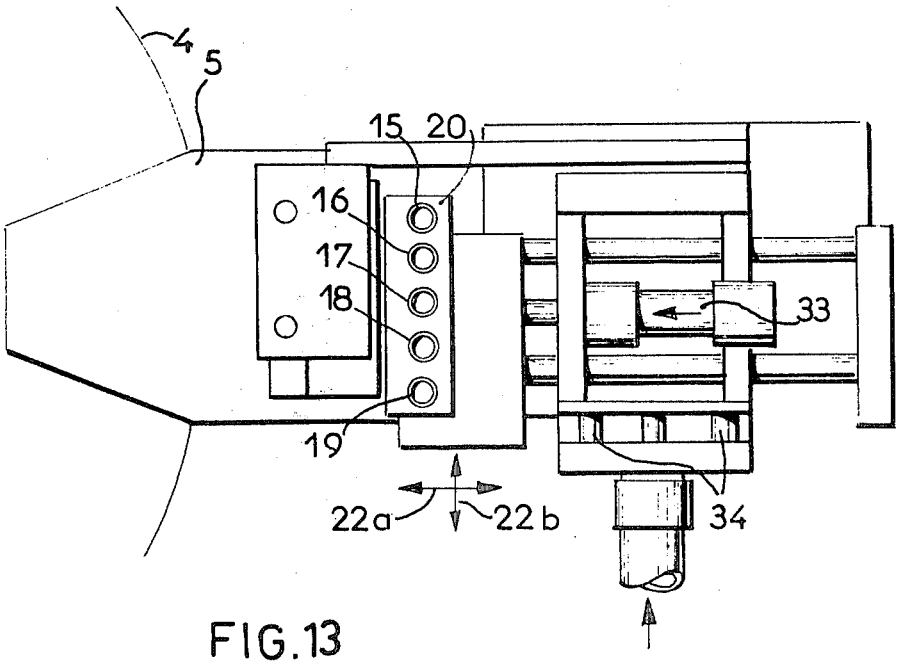
FIG.13

DISTRIBUTING MACHINE FOR PLACING STORED OBJECTS ON GRILL STANDS

FIELD OF THE INVENTION

The invention relates to distributing machines for distributing small objects in stands having a grill-type structure.

BACKGROUND OF THE INVENTION

It is of interest for presenting to the public to have grill stands which place pins so close together that the unit forms a homogeneous unit in which the pins rest against one another without rattling. In other words, the grill stands should have very close pockets delimited by relatively thin walls. This creates considerable difficulty in placing the pins in their respective pockets. Further, if it is desired that the pins stay in their pockets and not slide out, they should not float, i.e., placement should be made with a certain holding friction, which results in a tight fit. This also creates a second difficulty of placing the pins in their respective pockets.

So far, placing of the pins in their grill stands has been done by hand, hence the high cost, particularly because of the labor time required. Moreover, this mode of operation at times involved irregular appearances.

SUMMARY OF THE INVENTION

This invention has for its object a distributing machine for placing stored objects on grill stands. More particularly, but not exclusively, it has for its object a distributing machine for placing cylindrical elements, such as plastic expansion pins, in grill stands which are also plastic. Generally these grill stands for sale to the public and utilization by the user are plastic and are made up of a honeycomb container comprising, for example, a quadrangular plate with 50 pockets. This figure is only an example which will be used for the specification of the invention but is in no way limiting. For example, the grill stand may comprise 5 rows of 10 pins or, on the other hand, 10 rows of 5 pins. But for ease of disclosure it will be assumed that the grill stand comprises 5 rows of 10 pins each.

The purpose of this invention is therefore to create a distributing machine that assures a rapid rate of placing the pins in their pockets with complete reliability despite the difficulties mentioned above.

A distributing machine according to the invention is essentially characterized by the fact that it comprises:

a plate carrying the grills to be filled and that successively moves them under distributing stations;

distributing stations which are continuously fed pins from bulk pin bins;

pin transfer carriages between the distributing stations and grills;

sets of individual push rods to make the pins go from the transfer carriages into the grills carried by the plate;

and suitable mechanisms controlling the longitudinal and crosswise movement of the transfer carriages above the grills.

During passage under each loading station, a row of the grill is preferably filled in two passes of the transfer carriages, the pins of said row being distributed successively in alternative pockets.

Other features and advantages will come from reading the following specification and claims which were made with reference to the accompanying drawings.

BRIEF DESCRIPTION OF THE FIGURES

FIG. 12 is a partial side elevation of a distributing station according to the invention.

FIG. 13 is a plan view of the distributing station shown in FIG. 12. CL DETAILED DESCRIPTION OF THE PREFERRED EMBODIMENT In the embodiment shown in FIG. 1, a grill stand 1 provided with five rows of ten pockets 2 is intended to receive plastic pins 3. The machine according to the invention essentially comprises circular plate 4 radially carrying eight blades 5 on which means are provided for receiving and holding grills 1. Any known means may be utilized to rotate plate 4 and to hold grill stands 1 on blades 5 without exceeding the scope of the invention. The machine operator is located in front of loading station A and by suitable servo-command the grills, as a result of the rotation of plate 4 in the direction of arrow 6, successively pass in front of stations B, C, D, E, F, G and H.

Station B is a dead station in front of which nothing happens. At station C the first row of the grill, namely row 7, will be loaded in two successive passes each with five pins, i.e., ten pins, before going on to station D. At station D second row 8 will be successively loaded with two times five pins in the same way. Rows 9, 10 and 11 will be loaded with two times five pins opposite stations E, F and G in similar fashion. After this last station G, the grill will have then been loaded with fifty pins and when it reaches station H it will be ejected along arrow 12 to an evacuation chute (not shown) by push rod 13.

Figure 2:
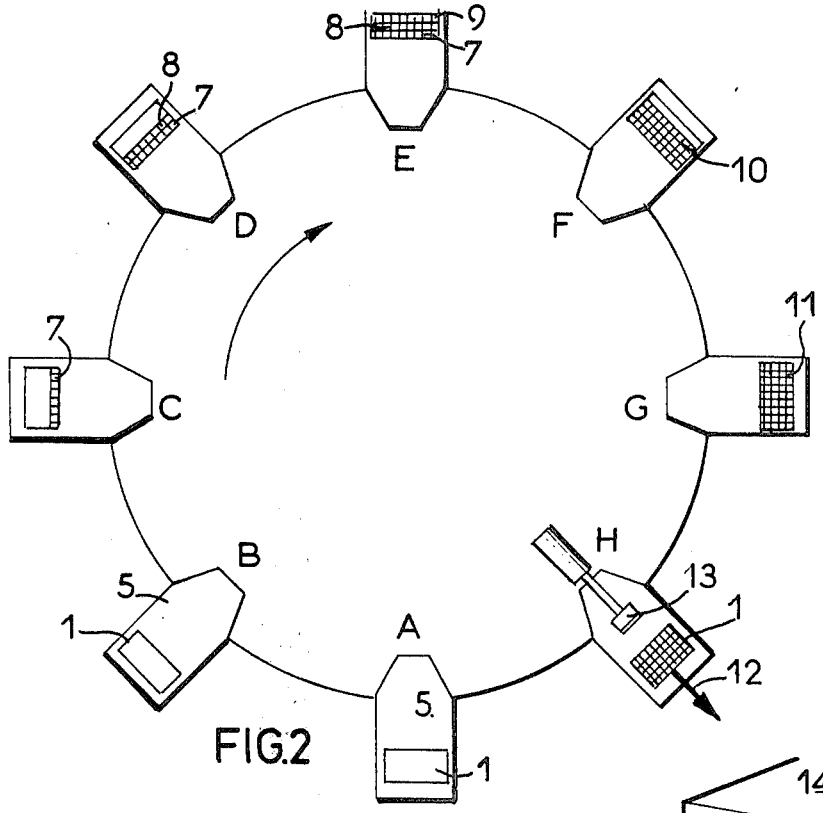
FIG. 2 is a plan view of the plate equipped with radial grill support blades according to the invention.
Figure 1:
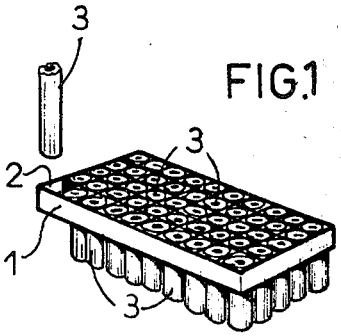
FIG. 1 is a schematic view in perspective of a grill stand loaded with its pins according to the invention.
Figure 3:
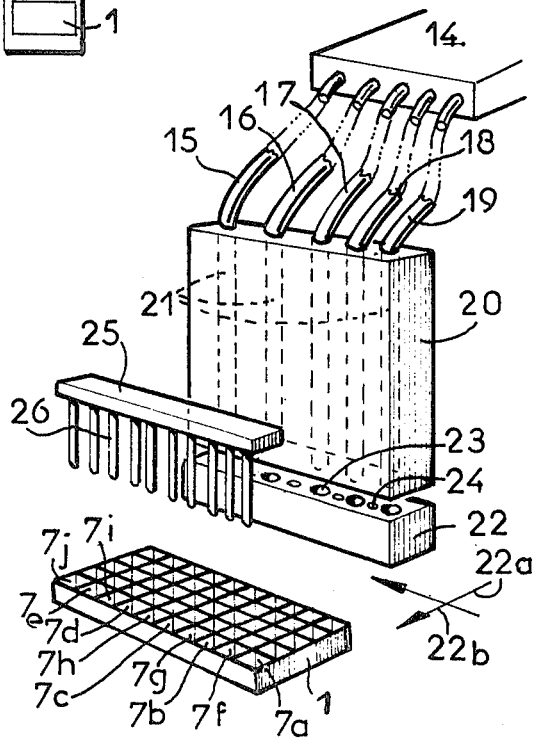
FIGS. 3 to 9 are schematic perspective views showing, in operating sequence, the pin distributing stations, pin transfer carriages between the distributing stations and grills, and the sets of individual push rods to make the pins go from the transfer carriages into the grills according to the invention.

With reference to FIGS. 3 to 9, as can be seen in FIG. 3, at the distributing stations C, D, E, F and G each of the distributing mechanisms includes an output element 14 of the bulk pin storage distributor from which pins come out aligned coaxially behind each other and pass in continuous lines through five rows of conduits 15, 16, 17, 18 and 19. The stationary vertical unit 20 at the upper end of which pin conduits 15 to 19 are attached is a vertical unit in which are provided vertical conduits 21 in which the pins descend by gravity to be distributed to transfer carriage 22. With the aid of any suitable control (electric, electromagnetic, electronic, hydraulic or pneumatic) this transfer carriage can be moved successively and alternately at right-angle movements along the directions of arrows 22*a* or 22*b*. In transfer carriage 22, whose role is to distribute pins to grill 1, there are provided two series of holes: five holes 23, on the one hand, and five holes 24, on the other hand. Spacing between the holes 23 corresponds exactly to the spacing between vertical conduits 21, said holes 23 being designed to receive a pin when they are coaxial with conduits 21. The transfer carriage 22 will then be loaded with five pins each time it is located under conduits 21. The placing of the pins in the grill is accomplished as follows: carriage 22 having been loaded with its five pins is moved in the direction of arrow *22a* to bring the pins over first row 7 of grill stand 1. In the first pass, pockets *7a, 7b, 7c, 7d* and *7e* will be loaded. Carriage 22 is then retracted back under unit 20 and again receives five pins. It is then moved back in the direction of arrow *22a* above first row 7 and further in the direction of arrow *22b*, this time to distribute five other pins in pockets *7f, 7g, 7h, 7j* alternating with respect to the preceding ones. It can be seen that such a staggering in the distribution requires carriage 22, after receiving its five pins for the second pass, a movement in the direction of arrow *22b*, the amount of this movement being equal to the distance between the centers of two consecutive pockets of the grill stand 1.

Tranfer of the pins from carriage 22 to each grill stand 1 is performed by vertical movement of a push rod carrier 25, carrying ten push rods as at 26 spaced apart the distance between the centers of two successive pockets. Guiding of push rod carrier 25 is such that it is carried by suitable movements to that opposite successive stations C to G, the row of push rods 26 goes down vertically through distributor carriage 22, successively opposite rows 7, 8, 9, 10 or 11 depending on its location opposite stations C, D, E, F or G. Since there are ten push rods, while at each pass only five pins are put into the grill, one rod out of two at each pass goes down through guide hole 24 of carriage 22 alternating with each pin receiving hole 23.

Figure 4:
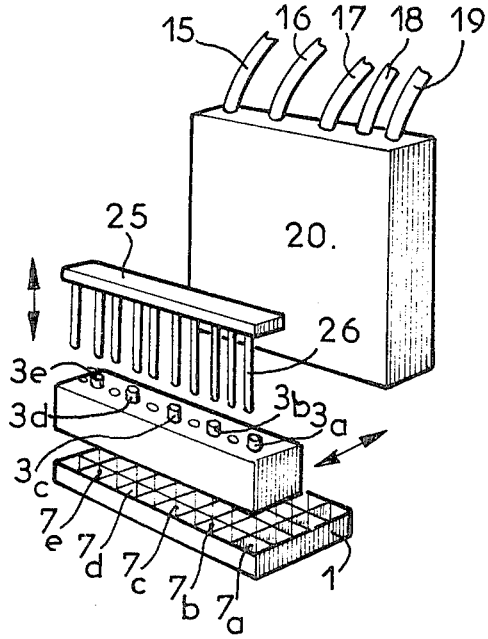

In FIG. 4 it is seen that carriage 22 is in an advanced position over grill stand 1 and in place to distribute pins *3a, 3b, 3c, 3d, 3e* in pockets *7a, 7b, 7c, 7d, 7e*, respectively.

Figure 5:
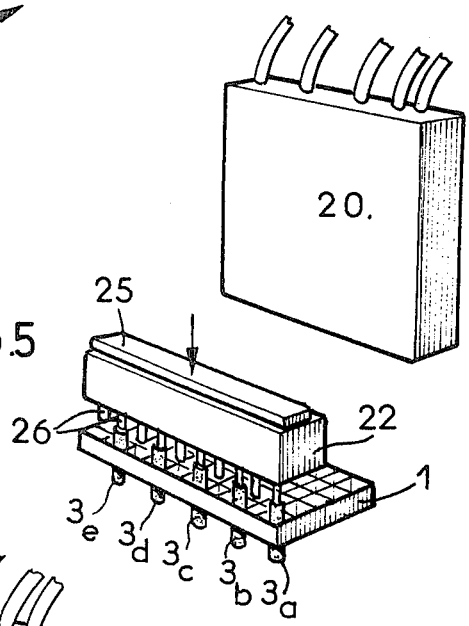
Figure 6:
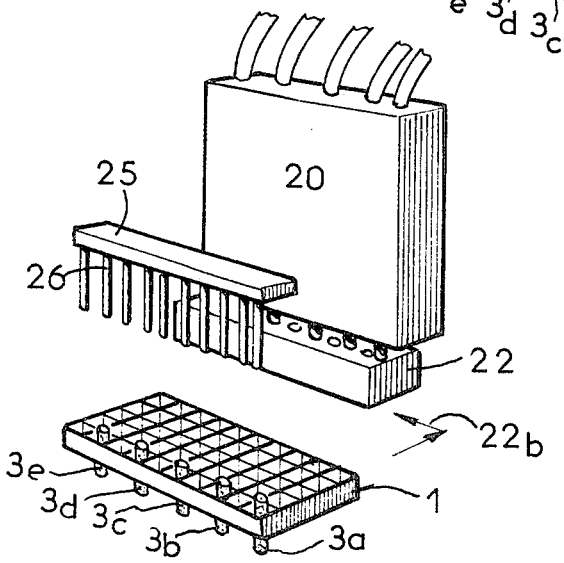

FIG. 5 shows push rods 26 extending down through transfer carriage 22 and pins *3a, 3b, 3c, 3d, 3e* put in place, in alternate pockets in first row 7 of grill 1. The grill thus loaded is shown in FIG. 6 where push rod carrier 25 has been retracted upwardly, while carriage 22 loaded again with five pins, as in FIG. 3, has been moved a notch in the direction of arrow *22b* before being brought above first row 7 of grill 1 to complete this row five new pins. The two successive passes thus having placed ten pins into first row 7.

Figure 7:
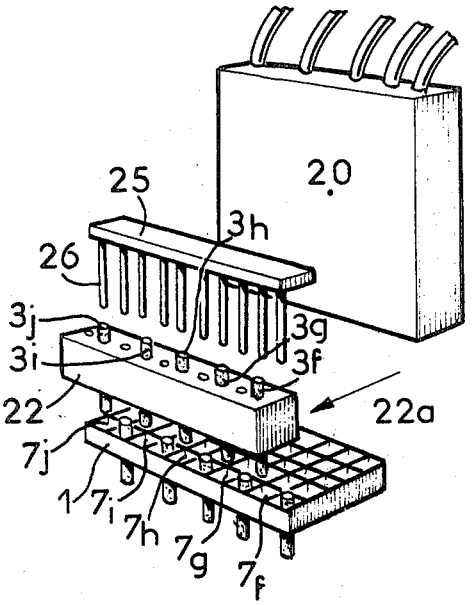
Figure 8:
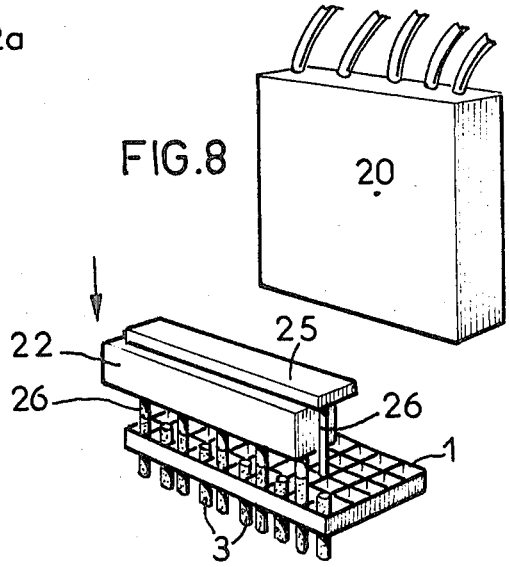
Figure 9:
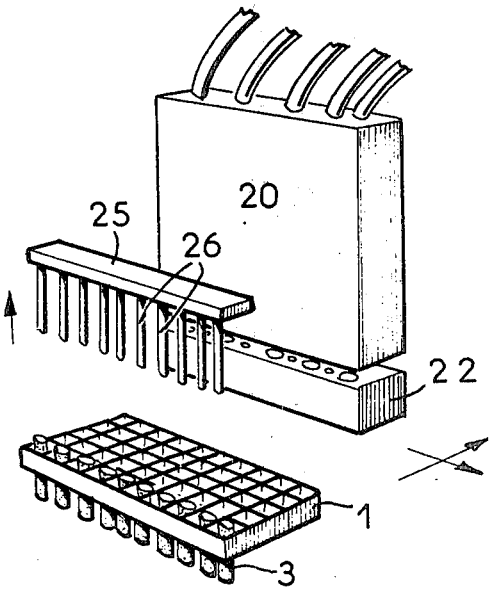

FIG. 7 represents a set of five new pins of the second pass at station C, represented as *3f, 3g, 3h, 3i, 3j*. Push rods 26 will perform their function by downward movement of rod carrier 25 (FIG. 8) and thus, on withdrawal of push rods 26 shown in FIG. 9, the first row of ten pins will have been put in place. Pockets *7f, 7g, 7h, 7i, 7j* have respectively received their corresponding pins *3f, 3g, 3h, 3i, 3j*. When the various operations of filling the first row opposite station C have been completed, a suitable servo-command will make the plate 4 turn to bring the grill from station C to station D, so that at station D the second row 8 may be filled with ten pins in two successive passes of five pockets each.

Figure 10:
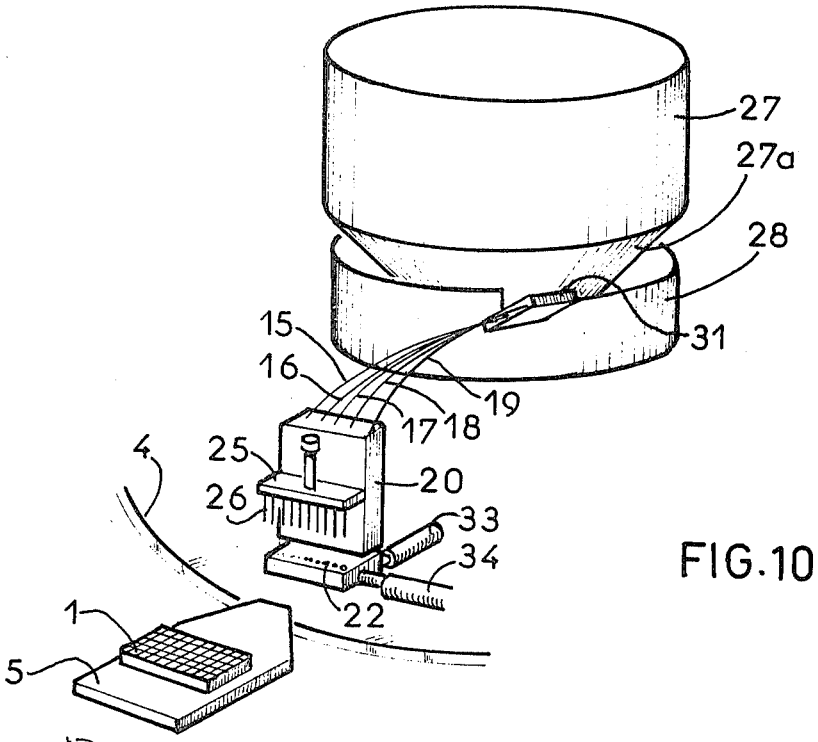
FIG. 10 is a schematic perspective view of the unit of a typical loading station of the distributing machine according to the invention.
Figure 11:
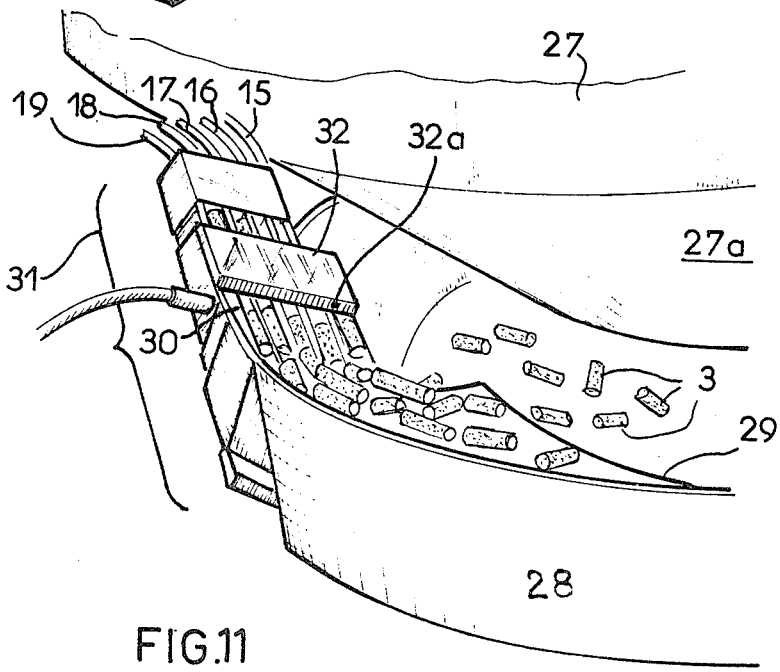
FIG. 11 is a partial schematic view showing the transfer of the pins from bulk storage to the conduits located upstream from the distributing stations.

FIG. 10 shows a typical station with its connection to a storage bin, with the same elements having the same reference numbers as those described above. The distributing station as previously described is connected to vibrating storage bin 27 containing the bulk pins, ending in its lower part with a funnel *27a* in the form of a truncated cone delivering the pins at a constant level to a lower bin 28. FIG. 11 is a rear view from the top showing the lower bin 28 in which bins 3 are stored. On the inside periphery of bin 28 a rising helicoidal ramp 29 is provided so that it permits the progressive rise of the pins due to their pushing one another until they come into distribution grooves 30 which are five in number and are upstream from distribution conduits 15, 16, 17, 18, 19. Apparatus 31 then is an element distributing five rows of successive pins pushing one another so that they are brought in order in conduits 15 to 19. It can further be noted that in the preferred embodiment conduits 21 are square in cross-section to assure only a tangential contact along the four generations of the pin and thus avoids to a maximum the friction forces that could brake the normal flow of the pins by gravity.

FIG. 11 shows plate 32 placed above the five distribution grooves 30 assuring an ordered flow of the pins in their slides to distribution conduits 15 to 19. In any case, if too many pins are brought above the five conduits 30, they would be stopped by edge *32a* of plate 32 and would fall back into the bottom of bin 28 since, as can be seen in FIGS. 10 and 11, the unit 31 is slightly inclined toward the inside of bin 28.

FIG. 10 shows cylinders 33 and 34 controlling the movement of transfer carriage 22 in the directions of arrows *22a* and *22b* (FIG. 3).

Of course, it is within the scope of a man of the art to make all servo-commands of the various joint movements of the distributing machine, without thereby going outside the scope of the invention.

FIGS. 12 and 13 show a working drawing the essential elements of the distributing machine with the same reference numbers as those used above. This has been done to give and even better understanding of the structure and functioning of the essential elements of the distributing machine according to the invention.

It goes without saying that it is possible, without going outside the scope of the present invention, to make any modifications in the embodiments just described. In particular, the movement of the grill carrying blades could be a longitudinal translation and not a circular movement.

I claim:

1. A distributing machine for placing stored cylindrical objects on grill stands having pockets in a plurality of rows parallel to the longitudinal axis of the grill, such as plastic expansion pins in grill stands which themselves are plastic, comprising:

(a) a plate carrying grills to be filled and which moves them successively under a plurality of distributing stations, each of which stations fills one of said rows of said grill ;

(b) bulk pin bins to continuously feed pins to the distributing stations;

(c) pin transfer carriages having pin carrying pockets spaced a distance equal to the distance between the centers of alternate pockets of said grill to transfer a plurality of pins from the distributing stations to the grills, (d) drive means to move the transfer carriages over the grills longitudinally and transversally relative to said grills and, (e) push rod means to transfer the pins from the transfer carriages into alternate pockets of a single row of the grills carried by the plate, (f) control means for said drive means to transversally move said carriages filled with one set of pins from the distributing stations to over one of said rows of the grills to thereby allow said push rod means to transfer said pins to alternate pockets of said one row and to longitudinally move said carriages a distance equal to the distance between the centers of two adjacent pockets of the grill after receipt of a second set of pins from said distributing stations to thereby allow said push rod means to transfer said second set of pins into the remaining alternate empty pockets of said one row of the grills.

2. A machine according to claim 1 wherein the transfer carriage receives pins from said bulk pin via a stationary vertical unit provided with parallel conduits in which the pins descend into the transfer carriage by the force of gravity.

3. A machine according to claim 2 wherein said pockets of the transfer carriages comprise of a series of holes therethrough aligned side by side and serving to receive a pin to be distributed or for guiding push rods on said push rod means.

4. A machine according to claim 3 wherein the drive means to move the transfer carriages lontitudinally and transversally moves them in right angles to each other.

5. A machine according to claim 1 wherein the bulk pin bins in which the pins are stored is a vibrating bin provided with a helicoidal ascending ramp for progessively bringing the pins toward a distribution means for arranging the pins in five parallel rows, and leading the pins aligned in five rows to conduits that are connected to the upper part of the distributing station.

* * * * *